US005989132A

United States Patent [19]

MacDonald et al.

[11] Patent Number: 5,989,132

[45] Date of Patent: Nov. 23, 1999

[54] GOLF CLUB IRON

[76] Inventors: David J. MacDonald, 2030 Fairchild Way, Los Osos, Calif. 93402-3314; Vardy Taylor Pearson, 189 N. 14th St., Rover Beach, Calif. 93433

[21] Appl. No.: 09/049,176

[22] Filed: Mar. 27, 1998

[51] Int. Cl.[6] ..... A63B 53/02

[52] U.S. Cl. ..... 473/314

[58] Field of Search ..... 473/313, 314, 473/349, 350

[56] References Cited

U.S. PATENT DOCUMENTS 2,683,036 7/1954 Klein .

5,199,707 4/1993 Knox .

5,338,029 8/1994 Falzone .

*Primary Examiner*—Sebastiano Passaniti

*Attorney, Agent, or Firm*—Leonard Tachner

[57] ABSTRACT

A golf club iron employs an elongated connection member to connect the lower end of a golf club shaft directly to the rear face of the golf club head over an elongated region between the top surface and the sole of the head. The connection region includes a line which is directly behind the center of mass of the head to enhance the transfer of energy to a golf ball where little or reduced torque is produced by off-center hits.

5 Claims, 2 Drawing Sheets

GOLF CLUB IRON

BACKGROUND OF THE INVENTION

FIELD OF THE INVENTION

The invention relates to a golf club of the iron type, and more particularly to such a club which produces improved distance upon striking the ball by more efficiently transferring the kinetic energy of the swing closer to the point of impact or center line of the ball than in a conventional iron.

Golf clubs are made in three distinct types or categories. The putter is designed to roll the ball on the ground without causing the ball to take flight. Irons and woods are designed to propel the ball through the air with various trajectories, and include the several woods (commonly now made with metal heads shaped like conventional woods), and the irons (1–9 irons, pitching wedge, and sand wedge).

The head of an iron comprises a hitting surface framed by a heel, a toe, a sole and a top surface. Between the heel and toe, the former is nearest the golfer when the club is in use and the latter is furthest from the golfer, with the striking face between the heel and toe. The club shaft defines a line center of force that propels the club. The shaft is ordinarily mounted at or attached to the heel of the club, and is accordingly mounted eccentrically with respect to the striking face.

When the iron is swung correctly and contact with the ball is made with a particular portion of the striking face (commonly referred to as "the sweet spot") the desired trajectory is produced. However, when the impact point is further out along the face of the iron or away from the golfer and closer to the toe, less energy is transmitted into the ball. Moreover, because there is a moment arm between the hosel and the sweet spot in conventional irons, the golfer must overcome an inherent torque induced even with proper contact and an increased torque with contact closer to the toe.

PRIOR ART

One recent attempt to overcome these deficiencies is disclosed in U.S. Pat. No. 5,338,029 to Falzone. The Falzone disclosure relates to an iron golf club head that also connects the golf club shaft directly to the rear surface of the head using a connecting device rather than a conventional hosel. However, the Falzone connection is made at a relatively precise unitary location which makes the striking point more critical between the sole and top surface. Moreover, because of the shape of the Falzone iron head connection member, the shaft terminates above the top surface and spaced behind the rear surface of the head. This permits off-center ball striking to still generate a torquing and twisting problem which defeats the substitution of connection member for hosel. Thus, while Falzone is a step in the right direction, it does not go far enough to provide an iron head which permits accurate trajectories with virtually any striking point on the club face.

SUMMARY OF THE INVENTION

According to a primary aspect of the invention, there is provided a golf club iron comprising a club head having a top surface, a sole, a heel and a toe, a rear surface and a forward striking face. Each of the rear surface and the striking face extends from the heel to the toe. The striking face lies in a first plane forming a loft angle with a vertical plane. The club head has a center of mass spaced from the sole. The club further comprises an elongated shaft having an axis extending downwardly and rearwardly of said striking face from an upper end thereof to a lower end thereof. A mounting member is provided for mounting a portion of the lower end of the shaft along the rear face at a region between the heel and the toe starting at the upper edge and extending to the sole with the axis lying in the vertical plane forming the loft angle with the first plane. The mounting member comprises an elongated and channeled receptacle connected to the rear face over an elongated area between the top surface and the sole. In a preferred embodiment, the shaft mounting member extends along the rear surface between the top surface adjacent the heel and the sole closer to the toe.

OBJECTS OF THE INVENTION

It is therefore a principal object of the invention to provide an improved golf club of the iron type wherein the shaft is connected to the club head by a connection member integral to the head along an elongated portion of the rear surface behind the center of mass to improve energy transfer from shaft-to-head-to-ball.

It is another object of the invention to provide a golf club iron wherein the lower end of the shaft is connected along an elongated region to the rear face of the head, the region including a line which is directly behind the center of mass of the club head.

It is still another object of the invention to provide a hoselless golf club iron wherein transfer of energy from golf shaft and head to ball is made more efficient by reducing head twisting normally caused by non-alignment of shaft and center of mass in conventional irons.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF THE PREFERRED EMBODIMENT

Figure 1:
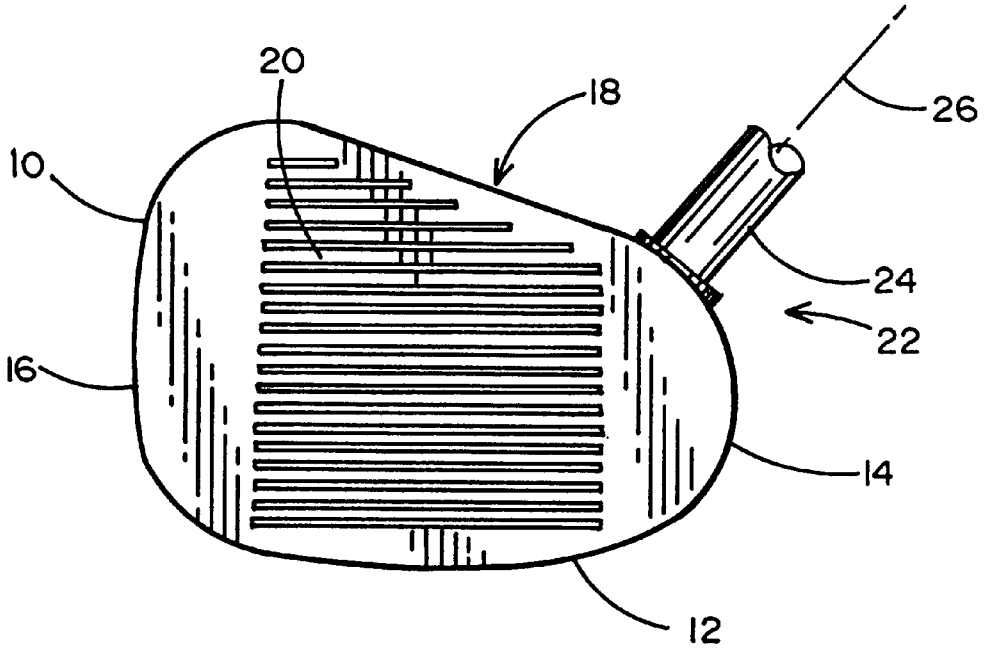
FIG. 1 is a front elevation view of the preferred embodiment.

The iron is illustrated in the accompanying figures at address, that is, in the position that a golfer would hold the club just prior to beginning the back swing, with the shaft in a generally vertical plane. With reference to FIG. 1, the iron comprises club head 10 having sole 12, heel 14, toe 16, and top surface 18. A forward striking face 20 extends from heel 14 to toe 16, and lies in a plane forming a loft angle with a vertical plane as viewed from the toe or heel of the club. Club head 10 has a center of mass spaced from sole 12, heel 14, toe 16 and top surface 18 and located behind striking face 20.

The club further comprises elongated shaft 22, only the lower portion or end 24 of which is illustrated. The upper portion (not illustrated) of shaft 22 may have the customary grip for the golfer's hands if desired. Shaft 22 extends downwardly and outwardly from the golfer along axis 26 to lower end 24.

According to the invention, mounting means are provided for mounting the lower portion 24 of shaft 22 on rear face

Figure 2:
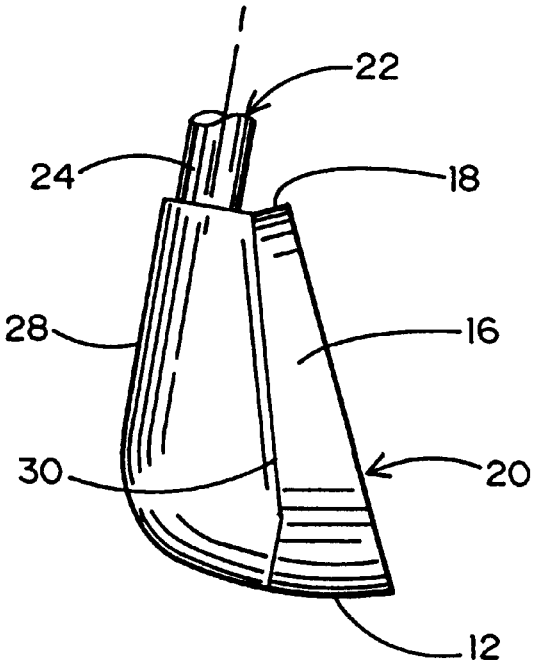
FIG. 2 is a side elevation view of the FIG. 1 embodiment.
Figure 3:
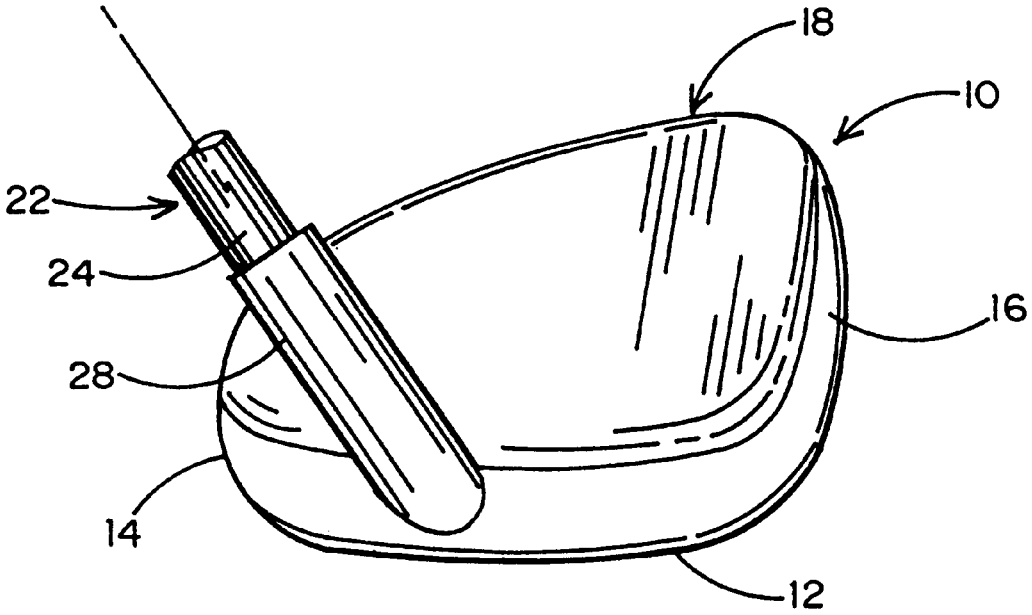
FIG. 3 is a rear elevation view of the FIG. 1 embodiment.

30 (FIGS. 2 and 3) at a location between heel 14 and toe 16, at or below upper edge 18 and at or above sole 12, with axis 26 lying in a vertical plane from which the loft angle of the striking face 20 is measured. The loft of the club face is dependent on the particular iron club. The mounting means is illustrated as a shaft connection member 28 attached to lower end 24, and is integral with rear face 30 of club head 10. As best illustrated in FIG. 2, member 28 extends from upper edge 18 to sole 12. Attachment of connection member 28 to rear face 30 is over an elongated region which may start below top surface 18 or end above sole 12. Preferably, the region of attachment of member 28 to rear surface 30 is on a line directly behind the center of mass. The connection member 28 has a receiving channel for receiving the lower end 24 of shaft 22.

The iron as thus described, substantially increases the amount of energy transferred from the shaft into the ball at ball striking.

We claim:

1. A golf club designed to produce greater distance and control of the ball, said club comprising:

a) an iron club head having a top surface, a sole, a heel and a toe, said club having a rear face and a striking face, each of said rear and said striking faces extending from said heel to said toe, said striking face lying in a first plane forming a loft angle with a vertical plane, said club head having a center of mass spaced from said sole;

b) a shaft having a terminal lower portion for connection to said head; and c) an elongated shaft connection member continuously connected to said rear face long an elongated region between said top surface and said sole, said shaft connection member having a shaft receiving channel for receiving said terminal lower portion of said shaft at a location closer to said sole than to said top surface.

2. The golf club defined in claim 1, wherein said elongated region includes a line passing through a point that is directly to the rear of said center of mass.

3. A golf club iron comprising:

an iron head having a rear surface surrounded by a heel, a toe, a sole and a top surface;

a shaft connected to said head; and a connection member having an elongated channel receiving said shaft and being integral to said rear surface along an extended region between said sole and said top surface, said extended region being spaced from said heel and from said toe;

said shaft terminating in said connection member at a location closer to said sole than to said top surface.

4. The golf club iron recited in claim 3 further comprising a center of mass and where said extended region is directly behind said center of mass.

5. The golf club iron recited in claim 3 wherein said extended region covers the entire distance from said sole to said top surface.

* * * * *